US009222683B2

(12) United States Patent
Ruponen et al.

(10) Patent No.: US 9,222,683 B2
(45) Date of Patent: Dec. 29, 2015

(54) SUPPLY AIR TERMINAL DEVICE

(75) Inventors: Mika Ruponen, Lahti (FI); Risto Paavilainen, Lahti (FI)

(73) Assignee: HALTON OY, Kausala (FI)

( * ) Notice: Subject to any disclaimer, the term of this patent is extended or adjusted under 35 U.S.C. 154(b) by 1347 days.

(21) Appl. No.: 12/821,572

(22) Filed: Jun. 23, 2010

(65) Prior Publication Data

US 2011/0000566 A1 Jan. 6, 2011

(30) Foreign Application Priority Data

Jul. 3, 2009 (FI) ..... 20095754

(51) Int. Cl.

| | |
|---|---|
| ***F24F 7/00*** | (2006.01) |
| ***F24F 1/01*** | (2011.01) |
| ***F24F 1/00*** | (2011.01) |
| *F24F 13/06* | (2006.01) |

(52) U.S. Cl.

CPC ..... *F24F 1/01* (2013.01); *F24F 1/0011* (2013.01); *F24F 2013/0616* (2013.01); *F24F 2221/14* (2013.01); *F24F 2221/46* (2013.01)

(58) Field of Classification Search

CPC ..... F24F 1/01; F24F 2221/14; F24F 13/04; F24F 13/26; F24F 2013/0616; F24F 2013/06

USPC ..... 454/254, 261, 263, 264, 270; 165/96, 165/123

See application file for complete search history.

(56) References Cited

U.S. PATENT DOCUMENTS

| | | | | |
|---|---|---|---|---|
| 6,203,421 | B1 * | 3/2001 | Black | 454/194 |
| 2009/0264062 | A1 * | 10/2009 | Miller et al. | 454/237 |
| 2010/0175397 | A1 * | 7/2010 | Choi et al. | 62/132 |
| 2010/0175411 | A1 * | 7/2010 | Choi et al. | 62/296 |
| 2010/0175418 | A1 * | 7/2010 | Choi et al. | 62/419 |
| 2010/0192611 | A1 * | 8/2010 | Yamaguchi et al. | 62/291 |
| 2010/0263829 | A1 * | 10/2010 | Kimura et al. | 165/59 |
| 2010/0294134 | A1 * | 11/2010 | Yokomizo et al. | 96/405 |
| 2012/0015599 | A1 * | 1/2012 | Nouchi | 454/251 |

FOREIGN PATENT DOCUMENTS

| | | | | |
|---|---|---|---|---|
| DE | 1778188 | A1 * | 11/1971 | F24F 1/01 |
| DE | 32 29 212 | A1 | 2/1984 | |
| DE | 3229212 | * | 9/1984 | |

(Continued)

*Primary Examiner* — Steven B McAllister

*Assistant Examiner* — Ko-Wei Lin

(74) *Attorney, Agent, or Firm* — Venable LLP; Eric J. Franklin

(57) ABSTRACT

A fresh airflow is conducted from a supply air chamber through nozzles into a ring-shaped mixing chamber. A circulated airflow is conducted from a room space into a cylindrical suction chamber inside a ring-shaped heat exchanger. From the suction chamber the circulated airflow travels through the heat exchanger into the mixing chamber. The nozzles are located in the upper part of the mixing chamber at a distance from each other on the periphery of at least one circle, whereby the mid-point of the circle is located on the vertical central axis of the supply air terminal device. The horizontal component of the direction vector of the fresh airflow discharging from each nozzle forms an angle β, which is in a range of 45-135 degrees, with the radius of said at least one circle, and the direction vector is directed downward, in relation to the horizontal plane at an angle α, which is in a range of 15-75 degrees, whereby a rotating airflow directed downward is formed in the mixing chamber.

7 Claims, 7 Drawing Sheets

(56) References Cited

FOREIGN PATENT DOCUMENTS

| | | | | |
|---|---|---|---|---|
| DE | 44 05 738 C1 | 6/1995 | | |
| DE | 298 22 930 U1 | 2/1999 | | |
| DE | 29822930 U1 * | 2/1999 | ..... | F24F 13/06 |
| DE | 20102737 U1 * | 2/2001 | ..... | F24F 1/00 |
| DE | 201 02 737 U1 | 7/2001 | | |

* cited by examiner

SUPPLY AIR TERMINAL DEVICE

CROSS-REFERENCE TO RELATED APPLICATIONS

This application claims priority to Finnish patent application 20095754 filed 9 Jul. 2009.

FIELD OF THE INVENTION

The invention concerns a supply air terminal device.

STATE OF THE ART

Supply air terminal devices or air-conditioning beams comprise a supply air chamber, a mixing chamber and a heat exchanger. The fresh airflow is brought from the supply air chamber into the mixing chamber, in which the fresh airflow is mixed with circulated air, whereupon the combined airflow is conducted into the room space. The circulated air is conducted into the mixing chamber through the heat exchanger, in which the circulated air can be heated or cooled. Using the same supply air terminal device it is possible in the summer time to attend to cooling of the room air and in the winter time to heating of the room air. In the summer time, the circulated air of the room is cooled, and in the winter time it is heated in the supply air terminal device's heat exchanger. The fresh airflow induces the circulated airflow to flow from the room through the heat exchanger and into the mixing chamber.

The DE 29822930 U1 utility model presents a round supply air terminal device. The embodiment shown in FIG. 1 comprises a cylindrical outer side wall, whose top edge is closed with a first round cover plate. In the top part of the cylinder, at a distance from the first round cover plate there is a second round cover plate, whereby in the space between the first and the second round cover plate a cylindrical supply air chamber is formed. In the supply air chamber's cylindrical outer side wall a supply opening is formed for the fresh airflow. In the lower surface of the supply air chamber's bottom, that is, in the lower surface of the second round cover plate, a ring-shaped heat exchanger is attached, whereby in between the heat exchanger's outer periphery and the cylindrical outer side wall a ring-shaped mixing chamber is formed. In the mixing chamber's ceiling plate, that is, in the supply air chamber's bottom plate, nozzles are placed at equal intervals along a circle's periphery to lead the fresh airflow from the supply air chamber into the mixing chamber. To the heat exchanger's lower surface a first peripheral guiding part is attached to form the inner wall of the mixing chamber's ring-like output opening. To the lower edge of the cylindrical outer side wall again a second peripheral guiding part is attached to form the outer wall of the mixing chamber's peripheral output opening. In addition, to the inner wall of the output opening a round grating is attached, through which the air-conditioned room space's circulated air is led into a cylindrical suction chamber formed inside the ring-like heat exchanger.

In the solution presented in this DE 29822930 U1 utility model, the fresh airflow is conducted from nozzles located in the mixing chamber's ceiling plate directly downward into the mixing chamber, wherein the fresh airflow is mixed with the circulated airflow forming a combined airflow. The circulated airflow is drawn from the air-conditioned room space through the round grating in the supply air terminal device's lower surface into the suction chamber and thence further through the heat exchanger and into the mixing chamber. The combined airflow is guided from a ring-like output opening in the mixing chamber's lower part sideways into the air-conditioned room space. The combined airflow travelling directly downward in the mixing chamber is discharged from the mixing chamber's output opening in a radial sideways direction into the air-conditioned room space.

SUMMARY OF THE INVENTION

In the supply air terminal device according to the invention there is a ring-like mixing chamber and inside this a ring-like heat exchanger. In the ring-like mixing chamber there is a cylindrical outer wall and a ring-like inner wall, which is formed by the outer periphery of the ring-like heat exchanger. The fresh airflow is blown through nozzles into the mixing chamber. The circulated airflow is taken from the air-conditioned room into a suction chamber, which is limited by the ring-like heat exchanger's inner periphery and from which it travels through the heat exchanger into the mixing chamber. In the mixing chamber, the fresh airflow and the circulated airflow are mixed together forming a combined airflow. The nozzles are placed in the mixing chamber's upper part at a distance from each other on the periphery of at least one circle, and the centre of the at least one circle is located on the vertical central axis of the supply air terminal device.

In the supply air terminal device according to the invention, the nozzles are placed on the periphery of said at least one circle in such a way that the horizontal component of the direction vector of the fresh airflow discharging from each nozzle forms an angle $\beta$, which is in a range of 45-135 degrees, preferably 90 degrees, with the radius of said circle, and the direction vector is directed downward, in relation to the horizontal plane at an angle $\alpha$, which is in a range of 15-75 degrees, preferably 30-60 degrees, most preferably 45 degrees, whereby in the mixing chamber there is formed a rotating airflow directed downward.

The rotating combined airflow formed in the mixing chamber and directed down-ward will discharge as a rotating airflow guided by the ring-like output opening of the mixing chamber sideways in the direction of the ceiling into the air-conditioned room space.

The rotating airflow in the mixing chamber improves the mixture of fresh airflow and circulated air, whereby the difference in temperature between them will be reduced quickly. The rotating combined airflow discharging from the output opening of the mixing chamber into the air-conditioned room space is mixed in the same manner more quickly with the room air, whereby a quicker levelling out is achieved of the difference in temperature and velocity in the room space. The velocity of the rotating airflow discharged into the room space is also quickly reduced, whereby the sense of draught is avoided. The rotating airflow improves the distribution of air and the thermal conditions in the air-conditioned room space. The rotating airflow also improves the induction degree of the supply air terminal device.

The invention will be described in the following by referring to some advantageous embodiments of the invention shown in the figures of the appended drawings, but there is no intention to restrict the invention to these alone.

DESCRIPTION OF ADVANTAGEOUS EMBODIMENTS

Figure 1:
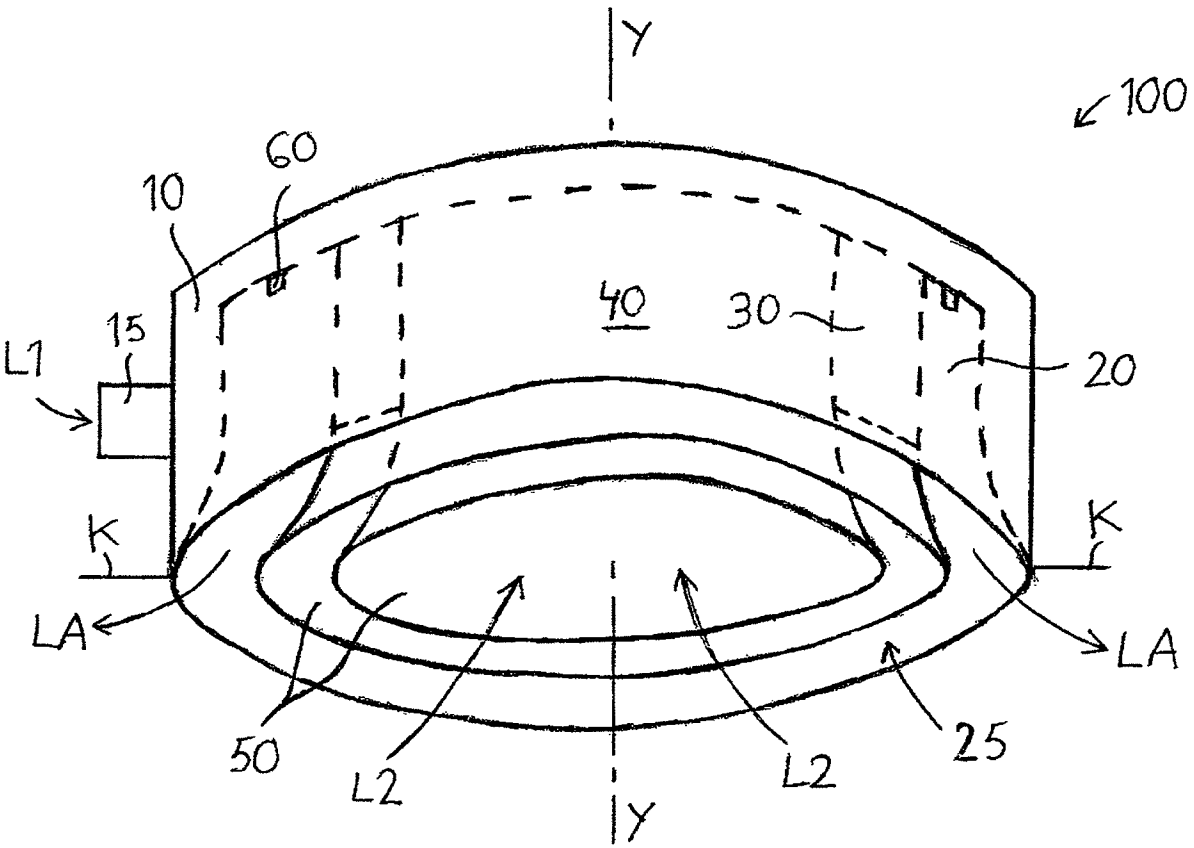
FIG. 1 is an axonometric view of a first embodiment of the supply air terminal device.

FIG. 1 is an axonometric view of a first embodiment of the supply air terminal device. A supply air terminal device 100 having a round shape is installed inside a false ceiling K. A fresh airflow L1 is conducted from a fresh air inlet sleeve 15 into a supply air chamber and from this further by way of nozzles 60 into a ring-shaped mixing chamber 20. A circulated airflow L2 is conducted from a room space into a cylindrical suction chamber 40, which is located inside a ring-shaped heat exchanger 30 and from which the circulated airflow L2 travels through the heat exchanger 30 into the mixing chamber 20. The fresh airflow L1 and the circulated airflow L2 are combined in the mixing chamber 20, whereupon the combined airflow LA is conducted from the mixing chamber's 20 output opening 25, which is located in the supply air terminal device's 100 lower surface, into the air-conditioned room space. The supply air terminal device 100 has a vertical central axis Y-Y.

Figure 2:
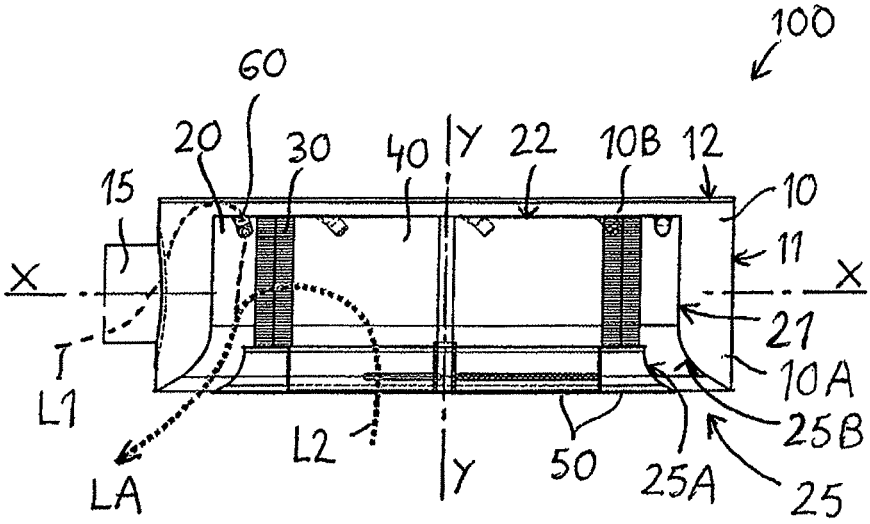
FIG. 2 is a vertical cross-sectional view of the first embodiment of the supply air terminal device shown in FIG. 1 in a first operational mode.

FIG. 2 is a vertical cross-sectional view of a first embodiment of the supply air terminal device shown in FIG. 1 in a first operational mode. The supply air terminal device 100 comprises a cylindrical side wall 21 and a round cover plate 22, which closes the top end of the cylindrical side wall 21. Inside the cylindrical side wall 21, at a distance from the cylindrical side wall 21, a ring-shaped heat exchanger 30 is fitted, whose top end is supported against the cover plate's 22 lower surface. In a space between the cylindrical side wall's 21 inner surface and the ring-shaped heat exchanger's 30 outer periphery a ring-shaped mixing chamber 20 is formed. The cylindrical side wall 21 forms the mixing chamber's 20 cylindrical outer side wall, the heat exchanger's 30 outer periphery forms the mixing chamber's 20 cylindrical inner side wall, and the round cover plate 22 forms the mixing chamber's 20 ceiling. In the cover plate's 22 lower surface, in the mixing chamber's 20 ceiling, at a distance from each other on the periphery of a circle M there are placed nozzles 60, through which a fresh airflow L1 is blown into the mixing chamber 20.

The lower part of the supply air terminal device 100 is closed by a round bottom plate 50, which has a central section 51 provided with openings and a conical peripheral section 52. The central section 51 of bottom plate 50 is preferably formed by a removable aperture plate. The outer periphery of the bottom plate's 50 conical peripheral section 52 forms the inner periphery 25A of the ring-shaped output opening 25 in the lower part of mixing chamber 20. The lower part of the mixing chamber's 20 outer side wall 21 is formed with a conical shape, so that it forms the outer periphery 25B of the mixing chamber's 20 ring-shaped output opening 25. A cylindrical suction chamber 40 is formed in the space limited by the inner periphery of heat exchanger 30, the lower surface of cover plate 22 and the top surface of the bottom plate's 50 central section 51 provided with openings. In this first operational mode, the bottom plate 50 is in its top position.

The supply air terminal device 100 also comprises a supply air chamber 10, in which there is a lower ring-shaped section 10A, which is formed outside the mixing chamber's 20 cylindrical outer side wall 21, and an upper compact cylindrical section 10B, which is formed above the cover plate 22. The supply air chamber 10 comprises a cylindrical outer side wall 11, which is located at a distance from the mixing chamber's 20 cylindrical outer side wall 21, and a round outer cover plate 12, which is located above cover plate 22, at a distance from this. The supply air chamber's 10 round outer cover plate 12 closes the top end of the supply air chamber's 10 cylindrical outer side wall 11. Between the supply air chamber's 10 round outer cover plate 12 and its lower round cover plate 22 a compact cylindrical space 10B is thus formed. The mixing chamber's 20 cylindrical outer side wall 21 forms the supply air chamber's 10 cylindrical inner side wall.

The supply air chamber's 10 lower ring-shaped section 10A comprises a horizontal X-X supply air sleeve 15, from which the fresh airflow L1 is brought into the supply air chamber's 10 lower section 10A, from which it is guided upward into the upper compact section 10B of the supply air chamber 10 and from this forward through nozzles 60 and downward into the mixing chamber 20.

The fresh airflow L1 will in the mixing chamber 20 form a vacuum, which will draw or induce a circulated airflow L2 from the air-conditioned room space into the suction chamber 40 and from this further on through the heat exchanger 30 into the mixing chamber 20, in which the fresh airflow L1 and the circulated airflow L2 form a combined airflow LA. The circulated airflow L2 can be cooled or heated in the heat exchanger 30. The combined airflow LA discharges from a ring-shaped conical output opening 25, which is located in the mixing chamber's 20 lower part, into the air-conditioned room space sideways and essentially in the direction of the room's ceiling surface.

Figure 3:
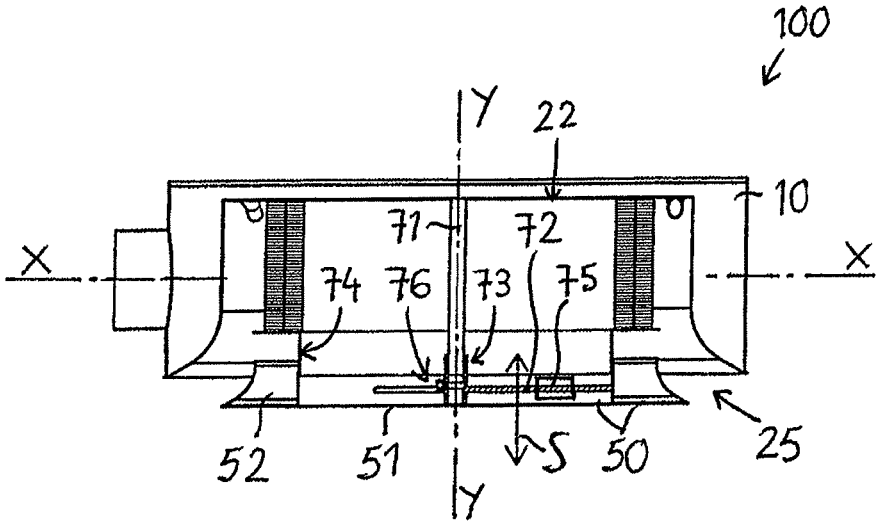
FIG. 3 is a vertical cross-sectional view of the embodiment shown in FIG. 2 in a second operational mode.

FIG. 3 is a vertical cross-sectional view of a first embodiment of the supply air terminal device shown in FIG. 1 in a second operating mode. In the vertical direction Y-Y the movable bottom plate 50 is here in its lower position, whereby the mixing chamber's 20 output opening 25 is largest. In addition, the supply air terminal device comprises a vertical Y-Y support shaft 71, whose top end is attached in a way allowing rotation to the lower surface of cover plate 22 and whose lower end comprises holes located in the transverse direction and at a distance from each other. A first bushing 73, which has a hole in the transverse direction, is fitted around the lower end of support shaft 71. A cotter pin 76 extends through the transverse hole of the first bushing 73 and one transverse hole of support shaft 71 forming a support point for the first bushing 73 in the support shaft 71. The inner end of a horizontal (X-X) support bar 72 is attached to the first bushing 73 and its outer end is attached to the bottom plate's 50 conical peripheral section 52. A second threaded bushing 75 is located in between the support bar's 72 inner end and outer end, which allows adjustment of the support bar's 72 length.

The bottom plate 50 can be moved in the vertical direction Y-Y in the manner shown by arrow S by moving the first bushing 73 along the support shaft 71 and by locking it at the desired location with the cotter pin 76. To the heat exchanger's 30 lower surface is attached a cylindrical third bushing 74, on whose outer surface the inner periphery of the bottom plate's 50 conical peripheral section 52 moves when the bottom plate 50 is lowered and raised in the vertical direction Y-Y. When the bottom plate 50 is raised to the top position, the mixing chamber's 20 output opening 25 is at its minimum, whereby a minimum airflow LA discharges from the output opening 25 out into the air-conditioned room space. When the bottom plate 50 is lowered to the lower position, the mixing chamber's 20 output opening 25 is at its maximum, whereby a maximum airflow LA discharges from output opening 25 and out into the air-conditioned room space. The bottom plate 50 can also be turned in the peripheral direction from the horizontal support bar 72, whereby the support shaft 71 will rotate at its point of attachment in the lower surface of cover plate 22.

Figure 4:
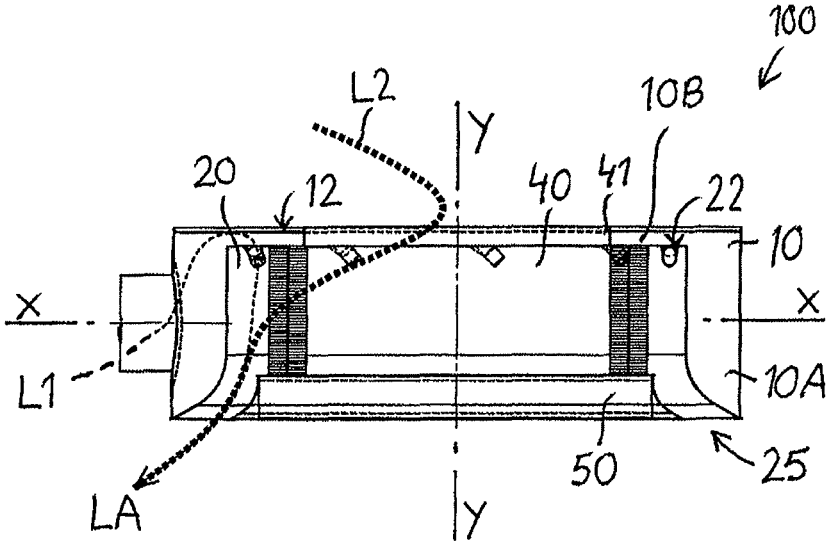
FIG. 4 is a vertical cross-sectional view of a second embodiment of the supply air terminal device in the first operational mode.

FIG. 4 is a vertical cross-sectional view of a second embodiment of the supply air terminal device in a first operating mode. This embodiment differs from the embodiment shown in FIG. 2 in that the supply air chamber's 10 upper section 10B is ring-shaped. In the upper section 10B of supply air chamber 10 there is a cylindrical inner side wall 41, which is located at the level of the heat exchanger's 30 inner periphery and which extends between cover plate 22 and the outer cover plate 12. This cylindrical inner side wall 41 of the supply air chamber's 10 upper section 10B forms the suction chamber's 40 upper outer side wall 41. There is an opening in cover 22 in the area limited by the cylindrical suction chamber's 40 upper side wall 41. The central part of outer cover 12 is provided with openings, whereby the circulated airflow L2 of the room space will travel through the outer cover's 12 openings into the suction chamber 40. The bottom plate 50 is here in its top position.

Figure 5:
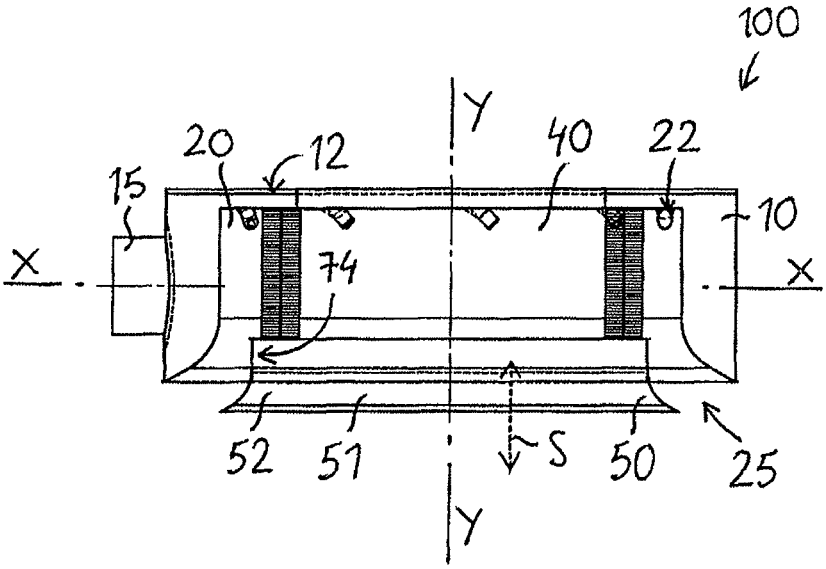
FIG. 5 is a vertical cross-sectional view of the embodiment shown in FIG. 4 in the second operational mode.

FIG. 5 is a vertical cross-sectional view of a second embodiment of the supply air terminal device shown in FIG. 4 in a second operating mode. The bottom plate's 50 central part 51 and outer part 52 are here formed by one piece, which closes the suction chamber's 40 lower surface. In other respects, the bottom plate 50 is similar to the bottom plate 50 shown in FIGS. 2 and 3. Here, too, a cylindrical bushing 74 is attached to the heat exchanger's 30 lower surface, and on its outer surface the inner surface of the bottom plate's 50 conical peripheral section 52 will move when the bottom plate 50 is lowered and raised in the vertical direction Y-Y. The S bottom plate 50, which can be moved in the vertical direction Y-Y is here in its lower position, whereby the mixing chamber's 20 output opening 25 is largest.

Figure 6:
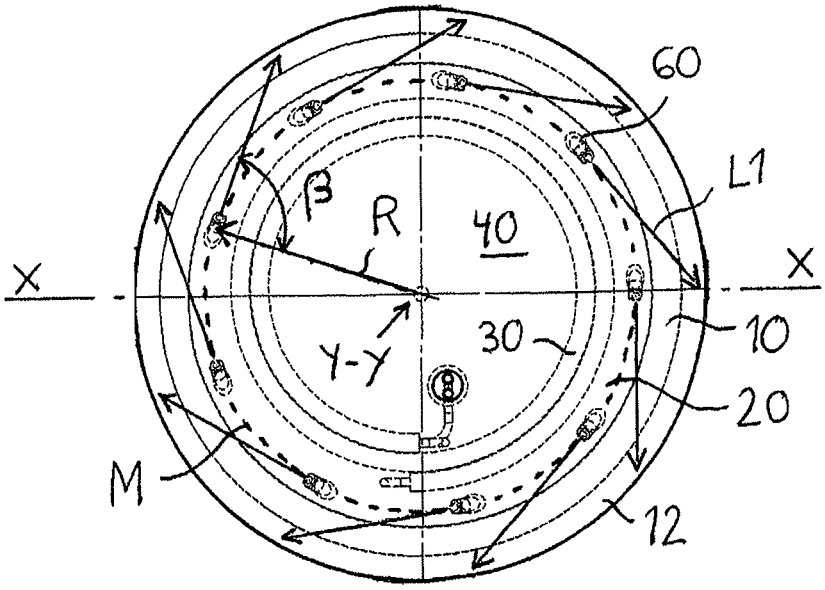
FIG. 6 is a horizontal cross-sectional view of the first embodiment of the supply air terminal device shown in FIG. 1.

FIG. 6 is a vertical cross-sectional view of the first embodiment of the supply air terminal device shown in FIG. 1. As the figure shows, the nozzles 60 are located at a distance from each other, preferably at equal distances, on the periphery of a circle M, in the ceiling of mixing chamber 20. The circle's M mid-point is located on the vertical central axis Y-Y of the supply air terminal device 100. The horizontal X-X component of the direction vector of the fresh airflow L1 discharging from each nozzle 60 forms an angle β with the radius R of said circle M. The angle β is preferably in a range of 45-135 degrees, most preferably 90 degrees. In this embodiment there are nine nozzles 60, but the number of nozzles 60 may of course vary. There is no upper limit for the number of nozzles 60, but eight nozzles 60 may be regarded as a kind of lower limit, whereby there would be two nozzles 60 in each quadrant. An efficient turbulence is hereby achieved in the mixing chamber 20. The supply air terminal device's diameter may vary in a range of 300-1200 mm.

Figure 7:
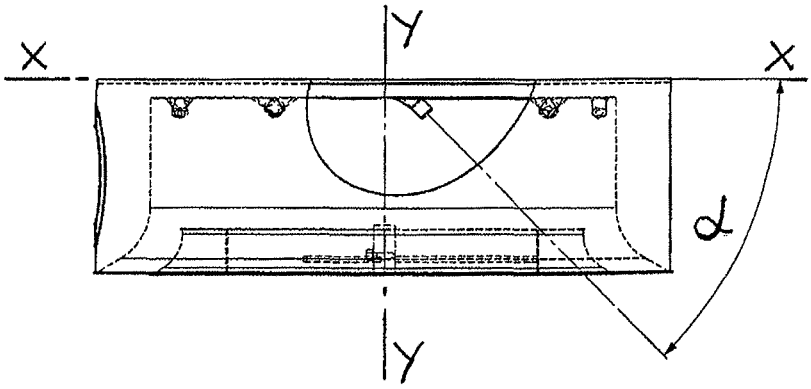
FIG. 7 is a vertical cross-sectional view of the first embodiment of the supply air terminal device shown in FIG. 1.

FIG. 7 is a vertical cross-sectional view of a first embodiment of the supply air terminal device shown in FIG. 1. As the figure shows, the direction vector of the fresh airflow L1 discharging from each nozzle 60 is also directed downward in relation to the horizontal direction X-X at an angle α, which is in a range of 15-75, preferably in a range of 30-60 degrees, most preferably 45 degrees, whereby a rotating airflow directed downward is formed in the mixing chamber 20.

The nozzle arrangement shown in FIGS. 6 and 7 brings about in the mixing chamber 20 a rotating airflow directed downward, which discharges from the mixing chamber's 20 output opening 25 sideways in the direction of the ceiling as a rotating airflow. The rotating airflow improves the mixing together of the fresh airflow and the circulated airflow in the mixing chamber, whereby the difference between their temperatures will be quickly reduced. The rotating airflow discharging into the air-conditioned room space is mixed more quickly with the room air, and the velocity of the rotating airflow discharging into the room space will be reduced quickly. This improves the air distribution and the thermal conditions in the air-conditioned room space. The solution also improves the supply air terminal device's induction degree.

Figure 8:
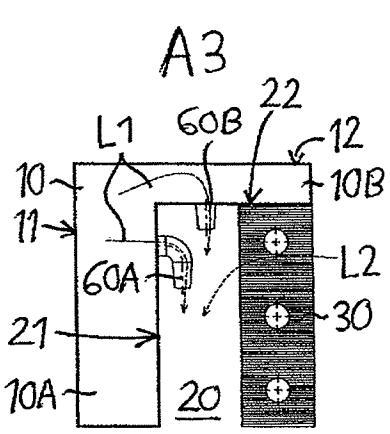
FIG. 8 shows cross-sectional views showing alternative embodiments of the supply air terminal device's supply air chamber and nozzles.
Figure 8:
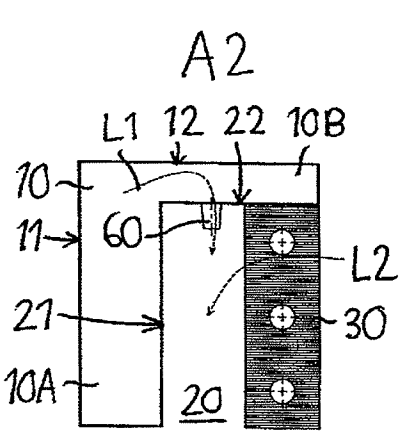
Figure 8:
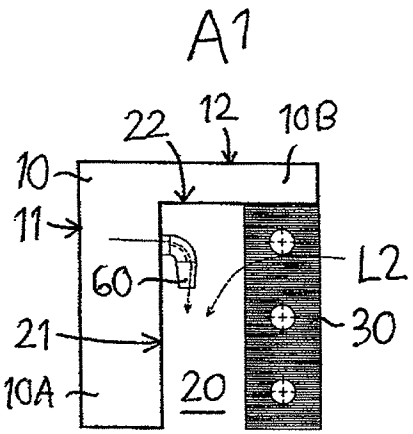
Figure 8:
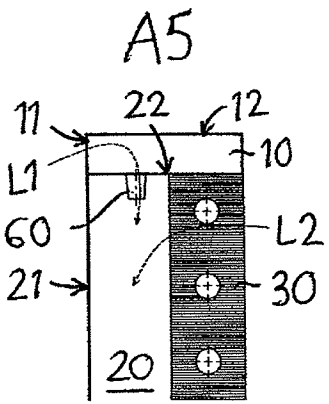
Figure 8:
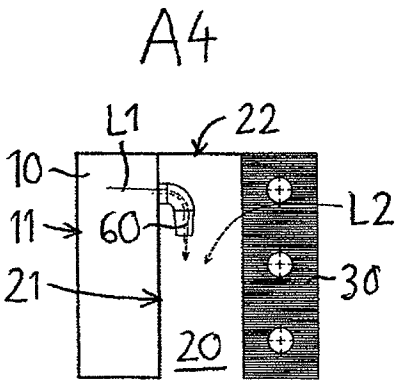

FIG. 8 shows cross-sectional views showing alternative embodiments of the supply air chamber and the nozzles. The cross-sections show one half of the supply air chamber 10, the mixing chamber 20 and the heat exchanger 30. The fresh airflow L1 is blown from the supply air chamber 10 through nozzles 60 into the mixing chamber 20. The circulated airflow L2 is conducted from the air-conditioned room space into the suction chamber located centrally in the supply air terminal device and then through the heat exchanger 30 into the mixing chamber 20.

In the embodiments A1-A3 of FIG. 8, supply air chamber 10 corresponds with the embodiments shown in FIGS. 2-5. In the supply air chamber there is a ring-shaped lower section 10A and a compact or ring-shaped upper section 10B. In the supply air chamber 10 there is a cylindrical outer wall 11, a cylindrical inner wall 21, a ceiling plate 22 and a roof plate 12. In embodiment A1, nozzles 60 are located in the mixing chamber's 20 outer wall, in embodiment A2, nozzles 60 are located in the mixing chamber's 20 ceiling plate. In embodiment A3, the first set of nozzles is formed by nozzles 60A, which are located in the mixing chamber's 20 outer wall 21, and a second set of nozzles is formed by nozzles 60B, which are located in the mixing chamber's 20 ceiling plate 22. In embodiment A3, a first set of nozzles 60A is located on the periphery of a first circle and a second set of nozzles 60A is located on the periphery of a second circle, whose radius is a bit shorter.

In embodiment A4 of FIG. 8, the supply air chamber 10 is formed only by a supply air chamber, which surrounds the mixing chamber 20 and which thus corresponds with the lower supply air chamber 10A shown in the embodiments A1-A3. The top edge of the supply air chamber's 10 cylindrical outer side wall 11 extends to the level of the mixing chamber's 20 ceiling 22. The mixing chamber's 20 roof plate 22 thus forms the roof of supply air chamber 10 and of the entire supply air terminal device. Nozzles 60 are located in the mixing chamber's 20 outer side wall 21, which at the same time forms the supply air chamber's 10 inner side wall.

In embodiment A5 of FIG. 8, the supply air chamber 10 is formed just by a supply air chamber above the mixing chamber 20, thus corresponding with the upper supply air chamber 10B shown in the embodiments A1-A3. The supply air chamber's 10 cylindrical outer side wall 11 joins the mixing chamber's 20 cylindrical outer side wall 21, whereby together they form the supply air terminal device's cylindrical outer wall. The mixing chamber's 20 ceiling plate 22 forms the supply air chamber's 10 bottom, and the supply air chamber's 10 roof plate 12 forms the supply air terminal device's roof.

Figure 9:
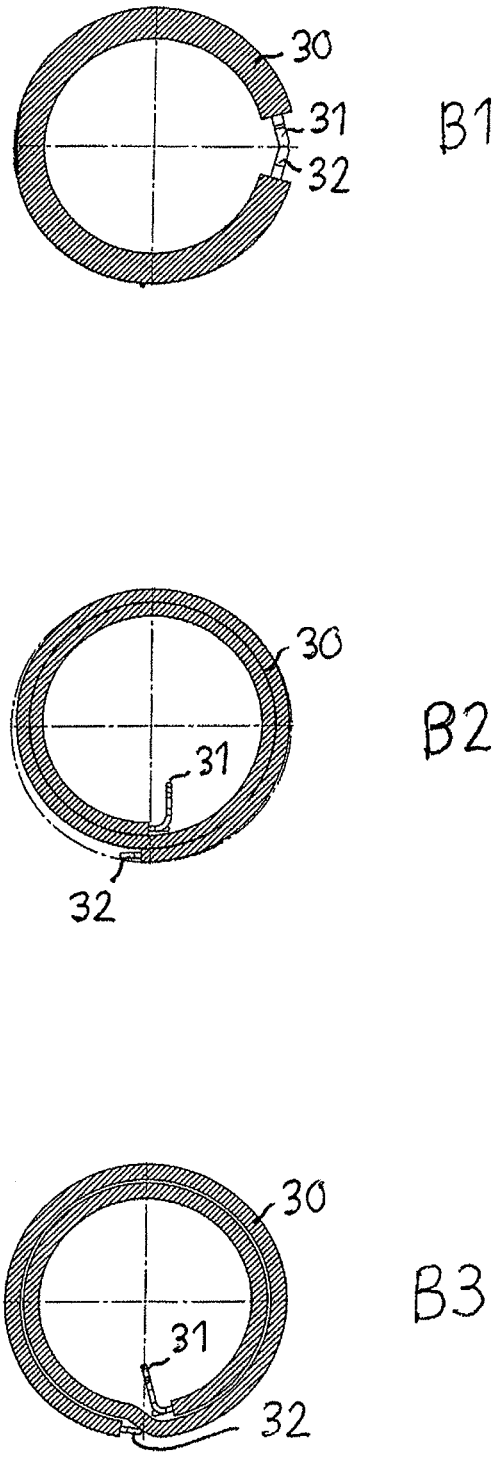
FIG. 9 shows cross-sectional views showing alternative embodiments of the supply air terminal device's heat exchanger.

FIG. 9 shows cross-sections, which show alternative embodiments of the heat exchanger. The heat exchangers 30 are preferably finned tube heat exchangers.

In embodiment B1 of FIG. 9, the heat exchanger 30 is formed by a loop having the shape of a circle. The liquid heat carrier flows from a first connection 31 into the heat exchanger 30 and from a second connection 32 from the heat exchanger 30.

In embodiment B2 of FIG. 9, the heat exchanger 30 is formed by a spiral loop. The liquid heat carrier flows from a first connection 31 into the heat exchanger 30 and from a second connection 32 from the heat exchanger 30.

In embodiment B3 of FIG. 9, the heat exchanger 30 is formed by two circular loops located one within the other. The liquid heat carrier flows from a first connection 31 into the heat exchanger 30 and from a second connection 32 from the heat exchanger 30.

With two circles or with a spiral heat exchanger a great difference in temperature is achieved between the liquid heat carrier circulating in the heat exchanger 30 and the air, and thus a high heat-transfer coefficient is achieved.

Figure 10:
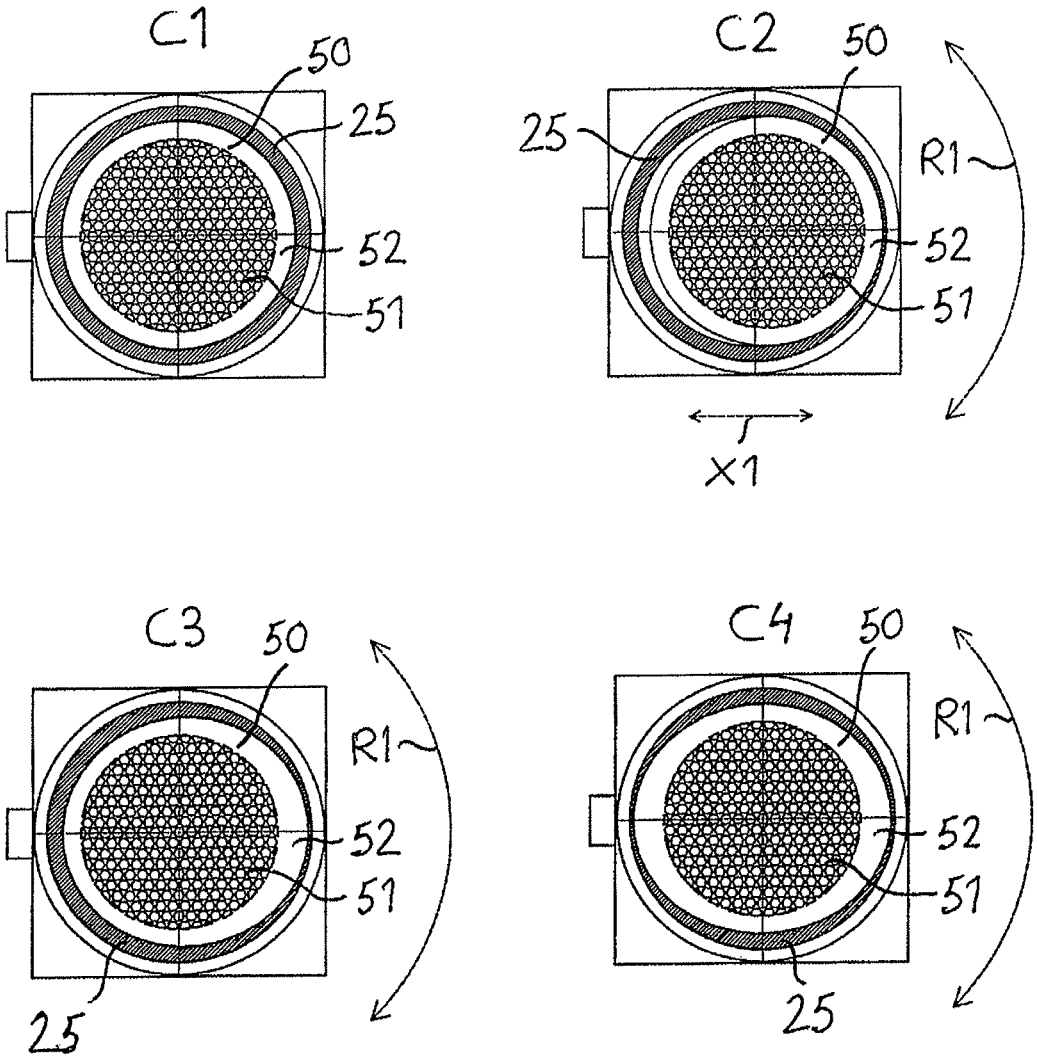
FIG. 10 shows cross-sectional views showing alternative ways of embodying the supply air terminal device's bottom plate.

FIG. 10 shows cross-sections, which show alternative embodiments of the bottom plate. The figures show a bottom plate 50, which thus comprises a central part 51, which may be solid or perforated, and a surrounding conical collar 52. The area shaded by oblique lines for its part shows the shape of the mixing chamber's 20 output opening 25.

Embodiment C1 of FIG. 10 shows a bottom plate 50, which is symmetrical in relation to the supply air terminal device's 100 vertical central axis Y-Y. The mixing chamber's 20 output opening 25 is here symmetrical in the whole peripheral area.

Embodiment C2 of FIG. 10 shows a bottom plate 50, which is eccentric in relation to the supply air terminal device's 100 vertical central axis Y-Y. The mixing chamber's 20 output opening 25 is formed with its left part larger at an approximate angle of 270 degrees and with its right part smaller at an approximate angle of 90 degrees. By moving the eccentricity of the X1 bottom plate 50 it is possible to adjust the eccentricity's strength. By turning the R1 bottom plate 50 it is possible to adjust the direction of the eccentricity.

Embodiment C3 of FIG. 10 shows an elliptical bottom plate 50. Here the mixing chamber's 20 output opening 25 corresponds in principle with the alternative shown in embodiment C2. By turning the R1 bottom plate 50 it is possible to adjust the direction of the eccentricity.

Embodiment C4 of FIG. 10 shows a strongly elliptical bottom plate 50. The mixing chamber's 20 output opening 25 is larger at the top and bottom at an approximate angle of 180 degrees and smaller on the left and on the right. By turning the R1 bottom plate 50 the direction of eccentricity can be adjusted.

In the embodiments A1-A3 of FIG. 8, the supply air chamber 10 is formed by a supply air chamber 10, which outside the outer periphery of the mixing chamber 20 comprises a compact or ring-shaped section 10A and above the mixing chamber 20 a ring-shaped section 10B, which join each other forming one compact supply air chamber 10. In embodiment A4 of FIG. 8, the supply air chamber 10 is formed by a ring-shaped supply air chamber 10 located outside the mixing chamber's 20 outer periphery. In embodiment A5 of FIG. 8, the supply air chamber 10 is formed only by a ring-shaped supply air chamber 10 located above the mixing chamber 20.

The top section 10B of the supply air chamber 10 may thus be formed by one compact and open cylindrical space or by a ring-shaped chamber, whose cylindrical inner side wall at the same time forms the suction chamber's 40 outer wall. In a situation where the supply air chamber 10 comprises only the section 10B above the mixing chamber 20, its cylindrical outer wall 11 joins the mixing chamber's 20 cylindrical outer wall 21. In a situation where the supply air chamber 10 comprises both section 10B above mixing chamber 20 and section 10A outside mixing chamber 20, the cylindrical outer wall of section 10B above mixing chamber 20 joins the cylindrical outer wall 11 of section 10A below the mixing chamber 20.

In the embodiments shown in the figures, the supply air chamber's 10 outer wall 11 is cylindrical, but its cross-section may also be a square, a rectangle, a trapezium, or a polygon. In a situation where the supply air chamber 10 is only located above the mixing chamber 20 and its outer wall is of a shape other than cylindrical, the mixing chamber's 20 cover plate 22 must also be adapted to the shape of the supply chamber's 10 lower surface, in order to have a closed supply air chamber 10. The mixing chamber's 20 ceiling plate 22 hereby extends in a radial direction at least partly outside the mixing chamber's 20 outer side wall 21.

In the embodiments shown in the figures, the supply air sleeve 15 is in connection with the supply air chamber's 10 outer side wall 11. It can of course also be located in connection with the supply air chamber's 10 roof 12.

In the embodiment shown in FIGS. 2-3, the circulated air L2 enters the suction chamber 40 through the openings in the bottom plate's 50 central part 51, and in the embodiment shown in FIGS. 4-5, the circulated air L2 enters the suction chamber 40 through the cover plate's 22 opening and through the outer cover plate's 12 perforation. Such an embodiment is also possible, where the circulated air enters the suction chamber 40 from two directions, that is, both through the bottom plate's 50 and the cover plate's 22 opening and through the outer cover plate's 12 perforation. In a situation where the cover plate 22 also forms the supply air terminal device's outer cover plate, circulated air L2 is brought into the suction chamber 40 through the openings in the cover plate's 22 central part.

The nozzles 60 may be located on the periphery of one or more circles. The embodiment A3 in FIG. 8 has two nozzle sets 60A, 60B, which are located on the periphery of two circles whose radii are of different lengths. Both circles have there mid-point located on the supply air terminal device's vertical central axis Y-Y. The presentation in FIGS. 6 and 7 applies to the alignment of all nozzles 60A, 60B.

In the embodiments shown in the figures, the combined airflow is guided by the shape of the inner periphery 25A and outer periphery 25B of the ring-shaped output opening 25 in the lower part of mixing chamber 20 sideways into the air-conditioned room space. This is an advantageous solution, because the combined airflow will not hereby be guided directly at people in the air-conditioned room space causing a sense of draught. However, the inner periphery 25A and outer periphery 25B of the ring-shaped output opening 25 in the lower part of mixing chamber 20 may also be shaped in some other way, whereby the combined airflow can be directed, for example, directly downward, if need be.

Only some advantageous embodiments of the invention were presented above, and it is obvious to an expert in the art that numerous modifications can be made to them within the scope of the appended claims.

The invention claimed is:

1. A supply air terminal device, comprising:

a cylindrical side wall, a ring-shaped heat exchanger, which is located inside the cylindrical side wall, at a distance from the cylindrical side wall, a cover plate, against which the top ends of the cylindrical side wall and of the ring-shaped heat exchanger are supported, a ring-shaped mixing chamber arranged in a space between the cylindrical side wall and the ring-shaped heat exchanger, whereby the cylindrical side wall forms a cylindrical outer side wall of the mixing chamber, the outer periphery of the heat exchanger forms a cylindrical inner side wall of the mixing chamber, and the cover plate forms a roof plate of the mixing chamber, a vertical central axis, nozzles, which are placed in the upper part of the mixing chamber at a distance from each other on the periphery of at least one circle, whereby the mid-point of the at least one circle is located on the vertical central axis of the supply air terminal device, a supply air chamber, from which a fresh airflow is conducted to the nozzles, a bottom plate, which comprises at least a section of a periphery, in which there are an inner periphery of the bottom plate and an outer periphery of the bottom plate, a ring-shaped output opening, which is located in the lower part of the mixing chamber and which comprises an inner periphery of the ring-shaped opening and an outer periphery of the ring-shaped opening, and a cylindrical suction chamber arranged in a space limited by the inner periphery of the heat exchanger and into which circulated airflow is drawn from an air-conditioned room space and from which the circulated airflow travels through the heat exchanger into the mixing chamber, wherein in the mixing chamber the fresh airflow and the circulated airflow form a combined airflow, wherein the nozzles are placed on the periphery of said at least one circle in such a way that the horizontal component of the direction vector of the fresh airflow discharging from each nozzle forms an angle, which is in a range of 45-135 degrees, with a radius of said at least one circle where each nozzle is placed, and the direction vector is directed downward in relation to a horizontal plane at an angle a, which is in a range of 15-75 degrees, causing a rotating combined airflow directed downward to form in the mixing chamber and a ring-shaped output opening of the mixing chamber is configured to guide the rotating combined airflow to discharge the airflow sideways in the direction of the ceiling into the air-conditioned room space.

2. The supply air terminal device according to claim 1, wherein the supply air chamber is defined:

by a lower section arranged around the cylindrical outer side wall of the mixing chamber and inside the outer side wall of the supply air chamber, wherein the outer side wall of the supply air chamber is located outside and at a distance from the cylindrical outer side wall of the mixing chamber, and by an upper section arranged above the cover plate, so that an outer cover plate of the supply air chamber includes a round outer cover plate located above the cover plate and at a distance from the cover plate, wherein the round outer cover plate is configured to close the top end of the cylindrical outer side wall of the supply air chamber.

3. The supply air terminal device according to claim 1, wherein a peripheral section of the bottom plate comprises a conical outer periphery, which forms the inner periphery of the ring shaped output opening, the cylindrical outer side wall of the mixing chamber comprises a conical lower part, which forms the outer periphery of the ring shaped output opening, whereby the ring-shaped output opening guides the combined airflow discharging from the mixing chamber sideways in the direction of the ceiling into the air-conditioned room space.

4. The supply air terminal device according to claim 2, wherein the bottom plate comprises an inner central section of the peripheral section of the bottom plate, in which there are openings, through which circulated airflow may travel from the air-conditioned room space into the suction chamber.

5. The supply air terminal device according to claim 4, wherein the central section of the bottom plate includes a round perforated plate, which is removable.

6. The supply air terminal device according to claim 2, wherein at least one of the central part of the cover plate and the outer cover plate of the supply air terminal device includes a section comprising at least one opening and through which circulated air travels from the air-conditioned room space into the suction chamber.

7. The supply air terminal device according to claim 3, wherein the outer periphery of the peripheral section of the bottom plate has an elliptical shape, whereby the output opening of the mixing chamber has an elliptical shape.

* * * * *